US005489015A

United States Patent [19]

Wood

[11] Patent Number: 5,489,015

[45] Date of Patent: Feb. 6, 1996

[54] COIN DISCRIMINATION APPARATUS

[75] Inventor: Dennis Wood, Oldham, England

[73] Assignee: Coin Controls Limited, Royton, England

[21] Appl. No.: 193,200

[22] PCT Filed: Mar. 31, 1992

[86] PCT No.: PCT/GB92/00574

§ 371 Date: Mar. 28, 1994

§ 102(e) Date: Mar. 28, 1994

[87] PCT Pub. No.: WO93/04448

PCT Pub. Date: Mar. 4, 1993

[30] Foreign Application Priority Data

Aug. 19, 1991 [GB] United Kingdom ..... 9117849

[51] Int. Cl.[6] ..... G07D 5/08

[52] U.S. Cl. ..... 194/318

[58] Field of Search ..... 194/317, 318, 194/319

[56] References Cited

U.S. PATENT DOCUMENTS

| | | | |
|---|---|---|---|
| 4,538,719 | 9/1985 | Gray et al. | 194/317 |
| 4,601,380 | 7/1986 | Dean et al. | 194/318 |
| 4,686,385 | 8/1987 | Sharpe | 307/261 |
| 4,754,862 | 7/1988 | Rawicz-Szcerbo et al. | 194/319 |
| 4,951,800 | 8/1990 | Yoshihara et al. | 194/317 |
| 4,995,497 | 2/1991 | Kai et al. | 194/318 |
| 5,007,520 | 4/1991 | Harris et al. | 194/317 |
| 5,033,603 | 7/1991 | Kai et al. | 194/334 |
| 5,158,166 | 10/1992 | Barson | 194/319 |
| 5,180,046 | 1/1993 | Les Hutton et al. | 194/319 |

FOREIGN PATENT DOCUMENTS

| | | | |
|---|---|---|---|
| 0164110 | 12/1985 | European Pat. Off. . | |
| 0404432 | 12/1990 | European Pat. Off. . | |
| 2169429 | 9/1987 | United Kingdom . | |
| 85/04037 | 9/1985 | WIPO | 194/317 |

*Primary Examiner*—F. J. Bartuska
*Attorney, Agent, or Firm*—Morgan & Finnegan

[57] ABSTRACT

An apparatus for identifying coins uses inductive coupling of the coin with a pair of inductors. The apparatus includes a path for coins to be tested, first and second inductors for forming concurrent inductive couplings with the coin being tested, switches for energizing the inductors in specific manners so that a sequence of coin tests results, and a sensor for sensing the resultant inductive coupling for each of the tests in the sequence.

15 Claims, 6 Drawing Sheets

COIN DISCRIMINATION APPARATUS

FIELD OF THE INVENTION

This invention relates to coin discrimination apparatus which has particular but not exclusive application to a multi-coin validator.

BACKGROUND OF THE INVENTION

In a conventional multi-coin validator, coins pass along a path past a number of spaced sensor coils which are each energised to produce an inductive coupling with the coin. The degree of interaction between the coin and the coil is a function of the relative size of the coin and coil, the material from which the coin is made and also its surface characteristics. Thus, by monitoring the change in impedance presented by each coil, as the coin passes it, data indicative of the coin under test can be provided. The data can be compared with information stored in a memory to determine coin denomination and authenticity.

The geometry of the coils in relation to the coin to be tested, strongly influences the degree of interaction between the coin and the coil. By selecting different coil geometries for the coil, different interactions and hence different characteristics of the coin can be tested.

For example, UK Patent No. 2 169 429 in the name of Coin Controls Limited discloses coin discrimination apparatus utilising three inductive sensor coils, two of which are disposed to one side of the coin path and are of different diameters, together with a third coil which is arranged to wrap around the path so that the coin under test passes axially through it.

SUMMARY OF THE INVENTION

The present invention provides an improved way of achieving an inductive coupling with a coin under test.

In accordance with the present invention there is provided coin discrimination apparatus comprising: means for defining a path for coins under test, first and second inductor means for forming concurrent inductive couplings with a coin under test during its passage along the path, switching means for causing energisation of the inductor means to produce a sequence of coin tests wherein for each thereof a different resultant inductive coupling is formed between the inductor means and the coin depending upon the manner of energisation of the first and second inductor means, and sensor means for sensing said resultant inductive coupling for each of said tests in the sequence.

The inductor means conveniently comprise first and second coils disposed on opposite sides of the coin path. The switching means conveniently is configured to switch current in a bi-directional manner through each of the first and second coils individually. The sequence of tests performed on the coin under test may comprise feeding current through the first coil individually, feeding current through the second coil individually, feeding current in the same sense through both of said coils concurrently, and feeding current in opposite senses concurrently through said first and second coils respectively.

The sensing means may comprise means for sensing the amplitude and/or frequency developed across the or each said coil for each said test.

Conveniently, the coils are arranged in an oscillatory circuit driven by an ac oscillator in a phase locked loop which tends to maintain the frequency of the oscillator at the natural resonant frequency of the oscillatory circuit as the coin passes the coil. The sensor means may comprise means for sensing the peak amplitude deviation of the oscillatory signal during each said test.

The peak amplitude deviations may be compared in a microprocessor with preprogrammed values in order to determine coin authenticity and/or denomination.

An array of optical detecting means may be provided adjacent the coin path for detecting coin diameter and/or thickness.

BRIEF DESCRIPTION OF THE DRAWINGS

In order that the invention may be more fully understood an embodiment thereof will now be described by way of example, with reference to the accompanying drawings in which.

DESCRIPTION OF EMBODIMENTS

Figure 1:
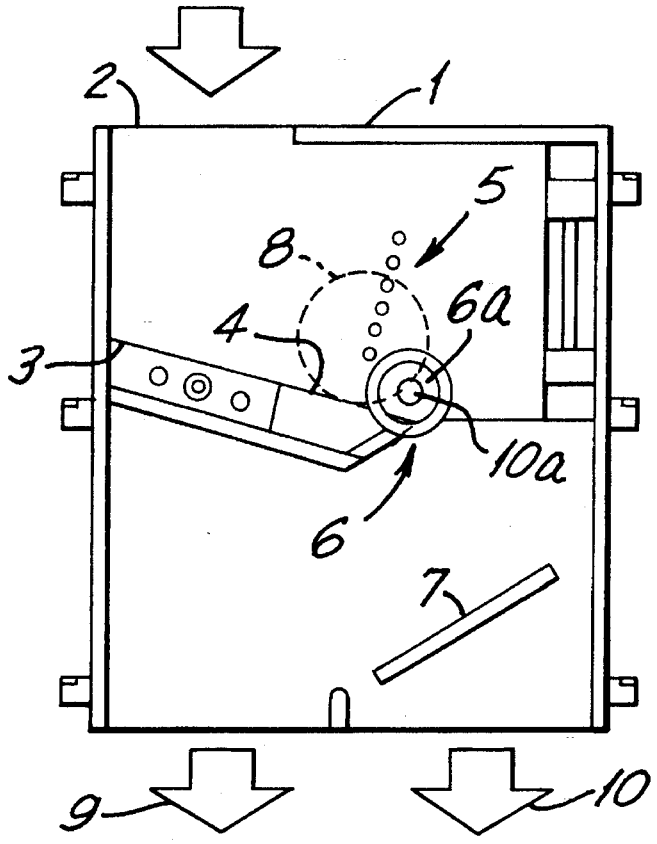
FIG. 1 is a schematic side elevational view of coin discrimination apparatus according to the invention.

Referring to FIG. 1, the apparatus consists of a body 1 including a coin inlet 2 in to which coins are inserted from above so as to fall onto an anvil 3 and then roll edgewise along a coin rundown path 4 past an optical sensing station 5 and then past an inductive sensing station 6. Outputs from the sensing stations 5, 6 are fed to electrical circuitry which will be described hereinafter with reference to FIG. 7, which controls operation of an accept gate 7 shown in FIG. 1. Thus, after leaving the inductive sensing station, the coin falls towards the accept gate. If the gate 7 is opened, the coin will fall into a coin accept chute 8; otherwise, the coin is deflected by the gate 7 into a reject chute 9.

Figure 2:
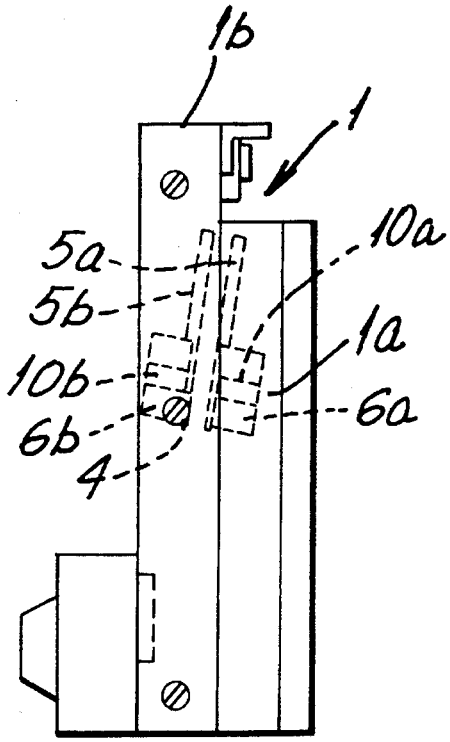
FIG. 2 is an end view of the apparatus shown in FIG. 1.
Figure 3:
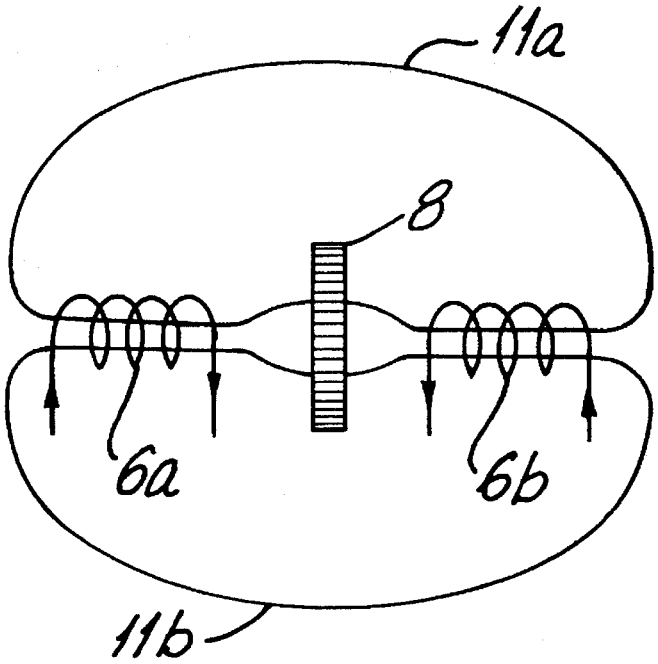
FIGS. 3 to 6 are schematic flux diagrams for different switching configurations of the sensor coils.

Referring to FIG. 2, the body member 1 consists of two hinged parts 1*a*, 1*b*. The optical sensing station consists of a linear array of light emitting devices 5*a* on the fixed side of the body, which are aligned with a corresponding array of photodetectors 5*b* on the hinged side of the body 1*b*. The light emitting devices and detectors are arranged in pairs so as to provide a line of light rays extending transversely across the coin rundown path 4. As the coin passes the optical sensing station 5, a number of the light rays are interrupted in dependence upon the diameter of the coin. Thus, by processing the outputs of the detectors 5*b*, a signal indicative of coin diameter can be obtained. Furthermore, as explained in co-pending GB Application No. 9024988.9, the output signals from the detectors 5*b* can be processed so as to compensate for any variations in coin velocity or coin acceleration down the rundown path 4. Also, by appropriately modifying the array of light emitting devices and detectors, it is also possible to obtain an indication of coin thickness. Reference is directed to the co-pending application aforesaid for a full description of diameter and/or thickness measurement.

The inductive sensing station 6 includes a pair of inductor coils 6*a*, 6*b* arranged on opposite sides of the coin rundown path, the coils having substantially identical geometrical and electrical characteristics. Each coil 6*a*, 6*b* is wound upon a plastic bobbin, with a cylindrical ferrite shield 10*a*, 10*b*, arranged on a common axis which extends normally of the major faces of the coin as it passes between the coils 6*a*, 6*b*. A coin 8 is shown schematically in dotted outline on the coin rundown path 4 in FIG. 1. The coils 6*a*, 6*b* are selected to have a sufficiently small diameter and to be located sufficiently close to the coin rundown path that the inductive coupling produced between the coil and the coin is virtually independent of the diameter of coin under test and remains at a maximum value for a portion of the time taken for a coin to pass the coils 6*a*, 6*b*. Typically, the coils have a diameter of 14 mm.

In accordance with the invention, a plurality of inductive tests are performed on the coin 8 whilst it passes through the inductive testing station 6. In the present example, four inductive tests are performed as will be explained in more detail with reference to FIGS. 3 to 6.

Test No. 1

This test is carried out by energising coils 6*a*, 6*b* with alternating currents in phase with each other so that the coils produce electromagnetic fields that constructively add to one another. The resulting flux pattern is shown schematically in FIG. 3 and is referenced 11*a*, 11*b*. It has been found that the resulting inductive coupling between the coils 6 and the coin 8 has a relationship in which the conductivity of the coin is emphasised.

Test No. 2

Figure 4:
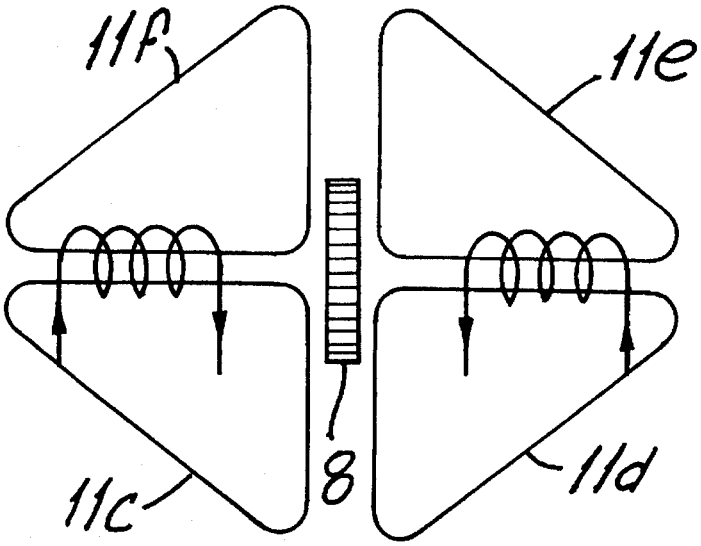

Referring to FIG. 4, in this test, the coils 6*a*, 6*b* are energised in such a manner, i.e. in anti-phase, as to produce opposed electromagnetic fields. The resulting flux pattern is shown schematically in FIG. 4 with flux equipotential lines being referenced 11*c, d, e, f*. It has been found that the inductive coupling between the coils 6*a*, 6*b* and the coin 8 has a relationship in which the permeability of the material from which the coin 8 is made, is emphasised.

Test No. 3

Figure 5:
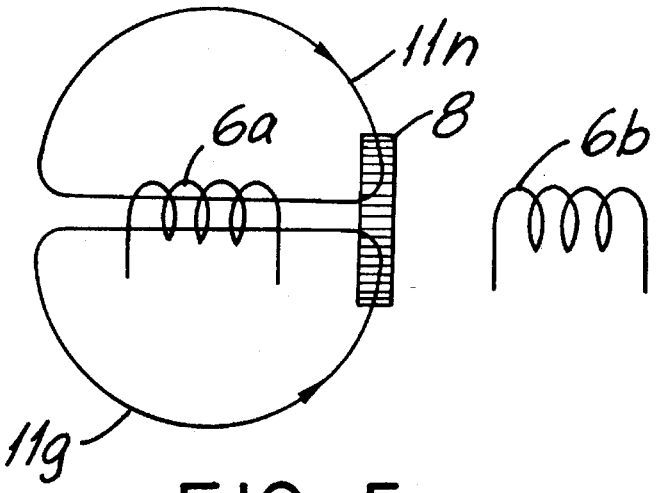

Referring to FIG. 5, in this test, coil 6*a* is energised individually i.e. without coil 6*b* being energised. The resulting flux pattern is shown by equipotential lines 11*g, h*. It has been found that the inductive coupling between the coin 8 and coil 6*a* has a relationship which is strongly influenced by the facial indentation of the coin 8.

Test No. 4

Figure 6:
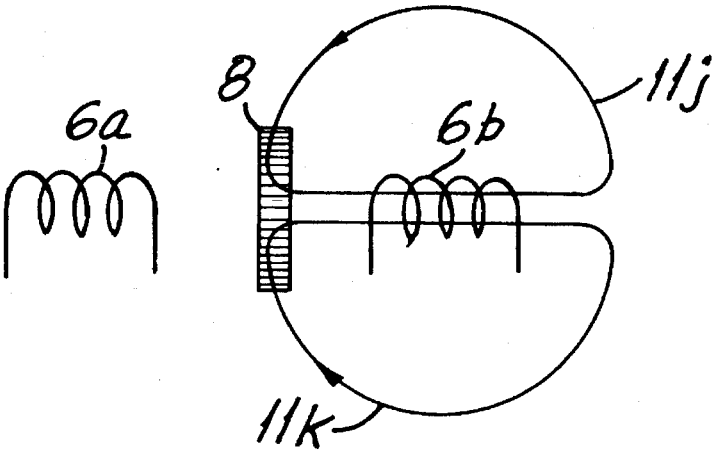

Referring to FIG. 6, in this test, coil 6*b* is energised individually i.e. without energising coil 6*a*. The resulting flux pattern is shown by equipotential lines 11*j, k*. For this test, the inductive coupling between the coil 6*b* and coin 8 is strongly influenced by coin thickness.

Figure 7:
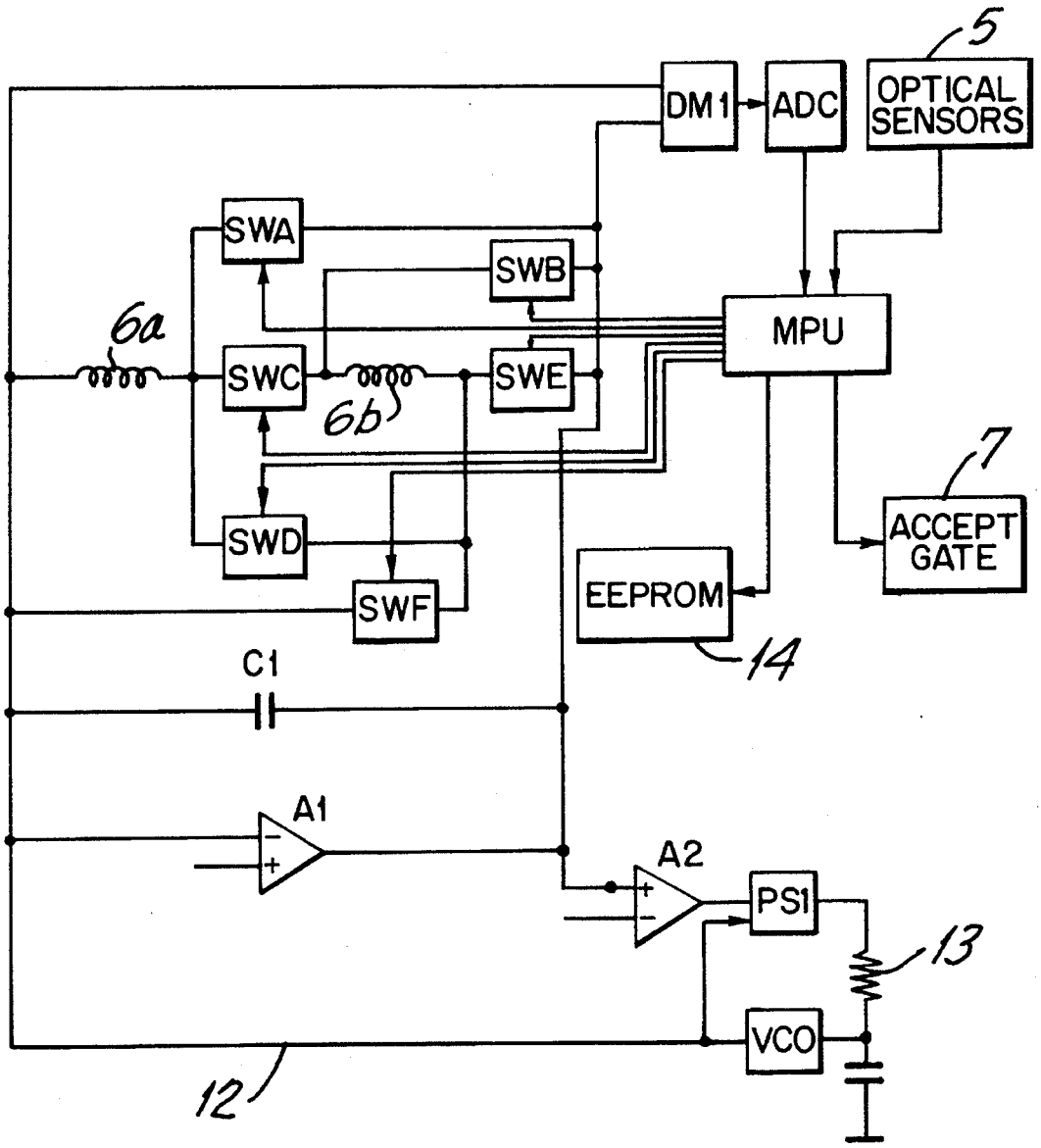
FIG. 7 is a block diagram of electrical circuitry I associated with the apparatus.

Referring to FIG. 7, drive current for performing the four tests is fed through the coils 6*a*, 6*b* under the control of transistor switches SWA, B, C, D, E, F operated by a microprocessor MPU.

The coils 6*a*, 6*b* are connected in an oscillatory circuit which includes the capacitor C1. The oscillatory circuit has its own natural resonant frequency when no coins are in the proximity to the coils 6*a*, 6*b*. The circuit is driven by a phase locked loop at its natural resonant frequency by means of a voltage controlled oscillator VCO which produces an oscillatory drive signal on line 12. The resonant circuit 6*a*, 6*b*, C1 is connected in a feedback path to an operational amplifier A1, the output of which is inverted by amplifier A2 and the resulting signal is compared in phase comparator PS1 with the output of the voltage controlled oscillator VCO on line 12. The output of the phase comparator PS1 comprises a control voltage on line 13 which is used to control the frequency of the voltage controlled oscillator VCO. The phase locked loop maintains 180° phase difference across the amplifier A1, which is the required condition to maintain the oscillatory circuit 6, C1 at its natural resonant frequency.

In the absence of a coin, the apparatus operates in an idle mode, in which the microprocessor MPU, the analog to digital converter ADC, the demodulator DM1 and the phase locked loop remain substantially inactive. A wake up sensor (not shown) which may comprise a simple optical detector, detects the presence of a coin on the rundown path 4 and produces a signal which causes the apparatus to switch from the idle mode to an active mode. Immediately after the apparatus becomes active but before the coin reaches the sensing station 6, the microprocessor MPU switches the switches SWA-F in a sequence such as to feed current sequentially through the coil 6*a*, 6*b* in a manner to perform the aforementioned tests 1 to 4. Thus, the switches are operated in accordance with the sequence set out in Table 1.

TABLE 1

| Switch | SWA | SWB | SWC | SWD | SWE | SWF |
|---|---|---|---|---|---|---|
| Test 1 | 0 | 0 | 1 | 0 | 1 | 0 |
| Test 2 | 0 | 1 | 0 | 1 | 0 | 0 |
| Test 3 | 1 | 0 | 0 | 0 | 0 | 0 |
| Test 4 | 0 | 1 | 0 | 0 | 0 | 1 |

In the Table, logic level 1 indicates a conductive switching state whereas logic level 0 represents a nonconductive switching state.

As the aforementioned Tests Nos. 1 to 4 are performed, a demodulator DM1 produces a signal representative of the amplitude of the oscillation developed for each test. Each of the four amplitudes is digitised by an analog to digital converter ADC and then stored by the microprocessor MPU to provide base reference values. For each test condition, the voltage controlled oscillator VCO will be driven at a frequency to maintain the resonant circuit at its natural resonant frequency for the test concerned.

Figure 8:
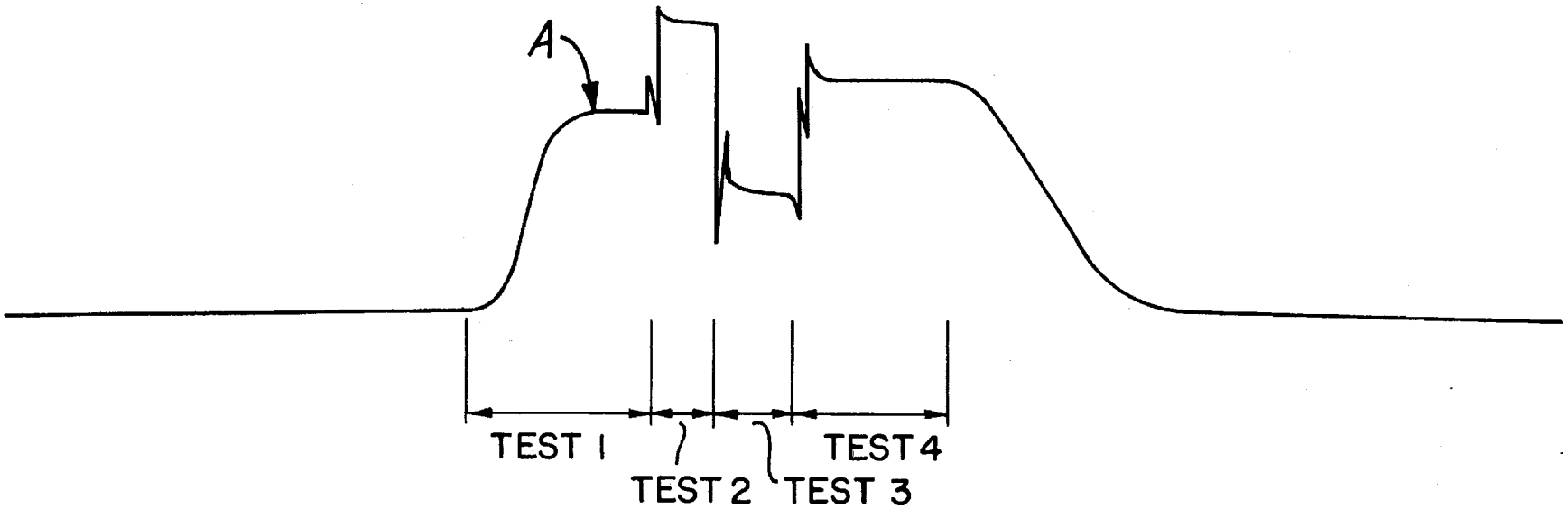
FIG. 8 shows a signal representative of the results of the sequential coin tests.

Referring to FIG. 8, once the base reference values have been established, the microprocessor MPU operates the switches SWA-F in order to perform one of the four tests, for example Test No. 1. The apparatus remains in this configuration until the microprocessor MPU detects a plateau in the amplitude of the oscillation developed during the test, indicated at A, or a predetermined time has elapsed, in which case the apparatus returns to its idle mode. The detection of the plateau indicates that the coin is at the testing station 6 and that, due to the arrangement of the coils 6*a*, 6*b*, the coupling will remain at a maximum for the duration of each of the tests Nos. 1 to 4. This means that although the output from the demodulator DM1 varies between tests, it remains substantially constant during each test.

If the plateau is detected, the microprocessor MPU stores the output from the analog to digital converter ADC and proceeds to operate the switches SWA-F in order to perform sequentially the remaining tests, the results of which are also stored.

For each test, the phase locked loop operates to maintain the circuit in resonance. In the presence of the coin, the inductive coupling between the coils 6*a* or 6*b* alters the natural resonant frequency of the resonant circuit defined by coil 6 in the capacitor C1, the inductive coupling being a function of characteristics of a coin. As previously discussed, each of the four test results in an inductive coupling in which a particular characteristic of the coin is emphasised. During each of the four sequential tests, the voltage controlled oscillator VCO maintains the resonant circuit 6, C1 at its natural resonant frequency, this frequency having been altered as a result of the inductive coupling between the coils and the coin. This results in a substantial amplitude variation in signal level being produced across the resonant circuit in comparison to that produced immediately after wake up. The amplitude variation is detected by demodulator DM1, an example of the output of which is shown in FIG. 8, and digitised by the converter ADC. The amplitude, in the presence of a coin for each test is then compared by the microprocessor with the aforementioned base reference values in order to provide a peak amplitude deviation for each of the four tests. These peak amplitude deviations are compared with stored values indicative of reference coins preprogrammed in an EEPROM 14 connected to the microprocessor MPU.

Also, the microprocessor MPU receives signals from the optical sensors 5 and processes them in order to obtain coin diameter information in the manner described in co-pending GB application 9024988.9 aforesaid. The diameter information is also compared with preprogramed values held in the EEPROM 14 for reference coins.

Thus, in this way, data representative of the coin under test can be compared with preprogrammed values in the EEPROM 14 in order to determine coin authenticity and denomination. If the coin is found to be acceptable, an enable signal is sent to accept gate 7 in order to allow the coin to pass into accept chute 8 (FIG. 1).

From the foregoing, it will be appreciated that the demodulator DM1 operates as a sensor means for sensing the inductive coupling between the coils **6*a* and/or 6*b* during the sequence of the four tests, the inductive coupling being manifested as an amplitude variation as a result of the phase locked loop holding the resonant circuit at its natural resonant frequency in the presence of a coin. The advantage of using such a phase locked loop arrangement is discussed in detail in GB Patent Specification 2 169 429. However, the inductive coupling can also be manifested in terms of a frequency change in which case the sensor means may sense a frequency deviation across the resonant circuit 6, C1**.

Figure 9:
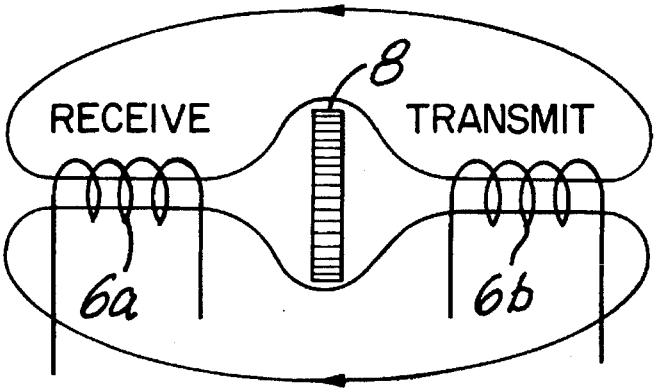
FIG. 9 illustrates schematically an additional test that can be performed with the sensor coils.
Figure 10:
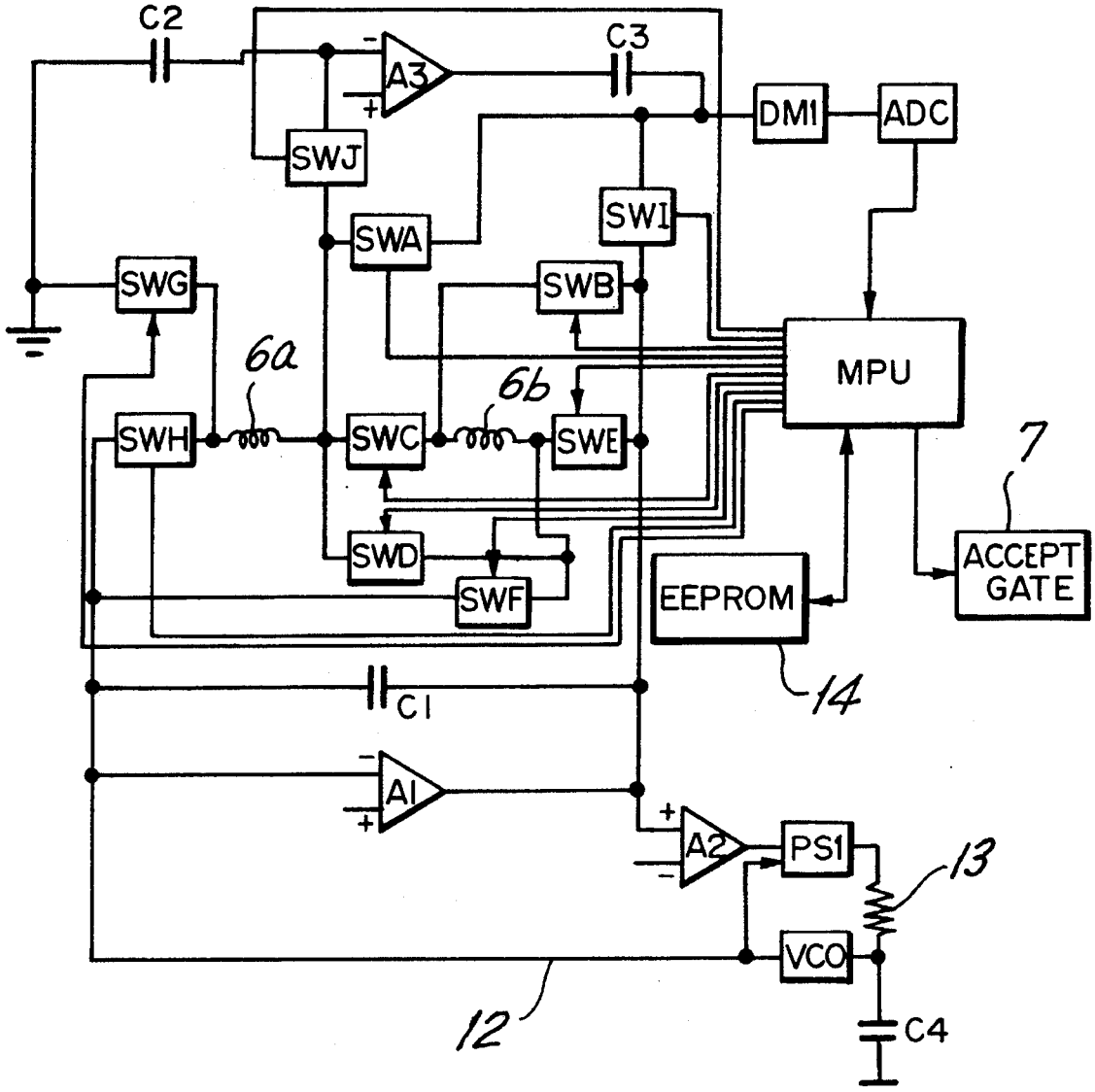
FIG. 10 is a block diagram of a modification to the circuit of FIG. 8, in which the coils are additionally arranged to perform the coin diameter test.

Referring now to FIGS. 9 and 10, a modification will now be described in which the coils **6*a*, 6*b* are connected in such a way as to provide coin diameter information by the performance of additional tests on the coin. This enables the optical sensing station 5 to be dispensed with, thereby simplifying the construction of the apparatus. To this end, the coils 6*a*, 6*b* are made larger than described with reference to FIGS. 1 to 7** and/or are mounted in a higher position relative to the coin rundown path, so that the inductive coupling between the coils is influenced by coin diameter.

Test No. 5

The general principle of the test referred to herein as Test 5, will be described. For this test, the coils are connected to provide a transmit-receive arrangement. As shown in FIG. 9, the coil **6*b* is used as a transmitter and the coil 6*a* is used as a receiver. As previously explained, for Tests Nos. 1 to 4, the self inductance of the coil 6*a* and/or 6*b* is monitored and the relatively small size of the coil relative to the coin produces a signal which, in the presence of a coin, is substantially independent of the coin diameter. However, it has been found for Test No. 5 that when the coin passes the coil arrangement, the leakage of flux around the coin into the receiver coil 6*a* is a function of the coin diameter. Thus, by measuring the amplitude of the signal induced in the receiver coil 6*a***, a signal as a function of coin diameter is provided.

FIG. 10 illustrates how the circuit of FIG. 7 can be modified in order to perform Test No. 5. Additional switches SWG-J are provided, connected as shown. Test Nos. 1–5 are performed by operating the switches according to the following table.

TABLE 2

| Switch | SWA | SWB | SWC | SWD | SWE | SWF | SWG | SWH | SWI | SWJ |
|---|---|---|---|---|---|---|---|---|---|---|
| Test 1 | 0 | 0 | 1 | 0 | 1 | 0 | 0 | 1 | 1 | 0 |
| Test 2 | 0 | 1 | 0 | 1 | 0 | 0 | 0 | 1 | 1 | 0 |
| Test 3 | 1 | 0 | 0 | 0 | 0 | 0 | 0 | 1 | 1 | 0 |
| Test 4 | 0 | 1 | 0 | 0 | 0 | 1 | 0 | 1 | 1 | 0 |
| Test 5 | 0 | 1 | 0 | 0 | 0 | 1 | 1 | 0 | 0 | 1 |

In the Table, logic level 1 indicates a conductive switching state whereas logic level 0 represents nonconductive switching state.

During the performance of Test No. 5, the transmitter coil **6*b* is connected in an oscillating circuit including amplifier A1 and capacitor C1 as previously described with reference to FIG. 7. The receiver coil 6*a* however, is connected through switches SWG and SWJ in parallel with capacitor C2 and the output of the resulting resonant circuit is fed through amplifier A3 and isolating capacitor C3 to the input of the demodulator DM1. In this arrangement, the amplitude of the signal induced in coil 6*a* is a function of coin dieter and is detected by demodulator DM1** for comparison with preprogrammed values in the microprocessor MPU.

It will be appreciated that by providing appropriate switches, it will be possible to perform an additional test, Test 6 in which the coil **6*a* is used as a transmitter and coil 6*b*** is arranged as the receiver. This configuration maybe used to cross check against the result of Test 5.

As a modification, separate coils may be provided for carrying out Test 5 and/or Test 6, the separate coils being switched by respective switches (not shown) under the control of the microprocessor MPU. Thus, Tests 1–4 would be performed with coils **6*a*, 6*b* as described with reference to FIGS. 1 to 8**, and thereafter, as part of the test sequence, the separate coils would be energised to perform Test 5 and/or Test 6.

It would be possible to measure diameter by means of a separate inductive coil arrangement in which case the test results would be affected by diameter as well as thickness, metal content and surface characteristics of the coin under test.

I claim:

1. A coin discrimination apparatus comprising:

means for defining a path for coins under test;

first and second inductor means for forming concurrent inductive couplings with a coin under test during its passage along the path;

switching means for causing energisation of the inductor means to produce a sequence of coin tests wherein for each test a different resultant inductive coupling is formed between the inductor means and the coin depending upon the manner of energisation of the first and second inductor means; and sensor means for sensing said resultant inductive coupling for each of said tests in the sequence.

2. Apparatus according to claim 1 wherein the inductor means comprise first and second coils disposed on opposite sides of the coin path.

3. Apparatus according to claim 2 wherein the switching means is operative to switch alternating current in a bi-directional manner through each of said first and second coils individually.

4. Apparatus according to claim 2 wherein said test sequence includes a test wherein alternating current is fed through the first coil individually.

5. Apparatus according to claim 2 wherein said test sequence includes a test wherein alternating current is fed through said second coil individually.

6. Apparatus according claim 2 wherein said sequence includes a test wherein alternating current is fed in phase through both of said coils concurrently.

7. Apparatus according to claim 2 wherein said sequence includes a test wherein current is fed in anti-phase through both of said coils concurrently.

8. Apparatus according to claim 2 wherein one of said coils is energised as a transmitter and the other of said coils is used as a receiver, the amplitude of the signal induced in the receiver coil being sensed by said sensor means.

9. Apparatus according to claim 8 wherein said sequence includes a test wherein the other of said coils is energised as a transmitter and the amplitude of the signal induced in said one of the coils is sensed by said sensor means.

10. Apparatus according to claim 2 wherein said sensing means includes means for sensing the amplitude or frequency deviation across the or each said coil for each said test.

11. Apparatus according to claim 10 wherein the coils are arranged in an oscillatory circuit driven by an ac source in a circuit which tends to maintain the frequency of oscillation at the natural resonant frequency of the oscillatory circuit as the coin passes the coils.

12. Apparatus according to claim 11 wherein the sensor means includes means for sensing the peak amplitude deviation of the oscillatory signal during each said test.

13. Apparatus according to claim 12 including microprocessor means operative to compare the peak deviation for each said test with at least one preprogrammed value thereof to determine coin authenticity or denomination.

14. Apparatus according to claim 13 wherein said microprocessor means is configured to operate said switching means.

15. Apparatus according to claim 1 including optical detecting means for detecting coin diameter or thickness.

* * * * *